US007172496B1

(12) United States Patent
Rodriguez et al.

(10) Patent No.: US 7,172,496 B1
(45) Date of Patent: Feb. 6, 2007

(54) METHOD AND APPARATUS FOR CLEANING SLURRY DEPOSITIONS FROM A WATER CARRIER

(75) Inventors: Jose Omar Rodriguez, Orlando, FL (US); Charles A. Storey, Orlando, FL (US); Andres B. Garcia, Ocoee, FL (US); Margareth Seputro, Orlando, FL (US); Frank Miceli, Orlando, FL (US)

(73) Assignee: Agere Systems, Inc., Allentown, PA (US)

( * ) Notice: Subject to any disclaimer, the term of this patent is extended or adjusted under 35 U.S.C. 154(b) by 0 days.

(21) Appl. No.: 11/205,382

(22) Filed: Aug. 17, 2005

(51) Int. Cl.
*B24B 55/00* (2006.01)

(52) U.S. Cl. ..... 451/41; 451/67; 451/288

(58) Field of Classification Search ..... 451/5, 451/65, 67, 41, 288, 287
See application file for complete search history.

(56) References Cited

U.S. PATENT DOCUMENTS

| | | | | |
|---|---|---|---|---|
| 5,733,171 | A * | 3/1998 | Allen et al. | 451/5 |
| 5,779,520 | A * | 7/1998 | Hayakawa | 451/41 |
| 6,251,001 | B1 * | 6/2001 | Pinson et al. | 451/449 |
| 6,402,598 | B1 * | 6/2002 | Ahn et al. | 451/65 |
| 6,505,636 | B1 * | 1/2003 | Travis | 134/179 |
| 6,520,839 | B1 * | 2/2003 | Gonzalez-Martin et al. | 451/41 |
| 6,629,883 | B2 * | 10/2003 | Katsuoka et al. | 451/332 |

FOREIGN PATENT DOCUMENTS

| | | | |
|---|---|---|---|
| JP | 62-224563 | * 10/1987 | 451/288 |

* cited by examiner

*Primary Examiner*—Robert A. Rose

(57) ABSTRACT

Disclosed herein is a process for diminishing contamination of an integrated circuit wafer caused by residual slurry components disposed on a back side of a carrier for engaging an integrated circuit wafer. Also disclosed is a CMP machine configured to wash a back side of a carrier.

5 Claims, 1 Drawing Sheet

METHOD AND APPARATUS FOR CLEANING SLURRY DEPOSITIONS FROM A WATER CARRIER

Conventional chemical/mechanical polishing (CMP) is used to create smooth topographies of the various layers of a semiconductor integrated circuit wafer during semiconductor device manufacture. The CMP process involves holding and rotating, using a wafer carrier, semiconductor wafer against a rotating polishing pad. The wafer carrier is typically a plate-like structure having a diameter slightly larger than the semiconductor wafer. The carrier is attached to a positioning device through a gimbal on its back side surface that allows the carrier to be spun and to pivot on the gimbal. The polishing pad, which is conventionally an open-celled, polyurethane pad affixed to a polishing platen, is wetted by a chemical slurry, under controlled chemical, pressure, and temperature conditions. The chemical slurry contains selected chemicals which etch or oxidize selected surfaces of the wafer during CMP in preparation for their mechanical removal. The slurry also contains a polishing agent, such as alumina or silica that is used as the abrasive material for the physical removal of the etched/oxidized material. The combination of chemical and mechanical removal of material during polishing results in superior planarization of the polished surface. In this process it is important to remove a sufficient amount of material to provide a smooth surface, without removing an excessive amount of underlying materials at each level of the manufacturing process to insure uniform and accurate formation of the semiconductor device at all subsequent levels. Accurate material removal is particularly important in today's sub-quarter micron technologies where it is critical to minimize thickness variation because the metal lines are thinner.

The inventors have discovered that the slurry sometimes splashes on the or back-side surface of the carrier during CMP. Further, when this splashed slurry dries, the silica and/or other components in the slurry become a contamination issue. Dried silica particles falling on the polishing pad is one of the causes of wafer scratches and failing particle counts when process checking a tool. The scratching results in potential wafer yield losses. The failing particle counts during process checking results in diminished tool availability since the tool must be taken out of production and cleaned.

SUMMARY OF THE INVENTION

According to one aspect, the subject invention pertains to a process of cleaning slurry from a back-side of a carrier used for transporting a wafer without having to interrupt the conventional CMP process. This process involves spraying the back-side of the carrier with a cleaning fluid at a predetermined time that is coordinated so as not to interfere with the CMP process. A specific aspect of the invention pertains to a process comprising spray washing the back side of a carrier concurrently with a conventional spray washing of a front side of the carrier at a time between unloading and loading of wafer from the carrier. In this form, no additional steps are needed to effect cleaning of the carrier so that the cycle time of the CMP process is not effected.

Another aspect of the invention pertains to a CMP machine comprising a spray nozzle associated with the CMP machine such that fluid is ejected out of the nozzle and aimed at the back side of a carrier so as to wash off undesired slurry components. The spray nozzle may be mounted to the CMP machine and connected to a fluid source. Typically, CMP tools comprise a polishing area in which the CMP process is conducted and an indexing area in which wafers are loaded into and unloaded from the wafer carrier. In a specific embodiment, the spray nozzle is mounted within the indexing area such that it directs fluid to the area of need on the carrier, such as the back side of the carrier. The indexing area includes spray nozzles and a spray wash process that washes slurry from the front or wafer contact surface of the carrier during a time between unloading of a polished wafer and loading of a next wafer to be polished. Applicants have modified the CMP tool by addition of a coupling from the front wafer wash source to a back wafer wash distribution system. The system includes flexible tubing and a plurality of spray nozzles mounted to the support mechanism for the wafer carriers. When the system actuates the fluid source for the front carrier wash, a flow of fluid is directed to the added tubing and nozzles to that fluid is sprayed onto the back side of the wafer carriers. Accordingly, both the back side and front side of the carriers are washed concurrently.

DETAILED DESCRIPTION OF THE INVENTON

Figure 1:
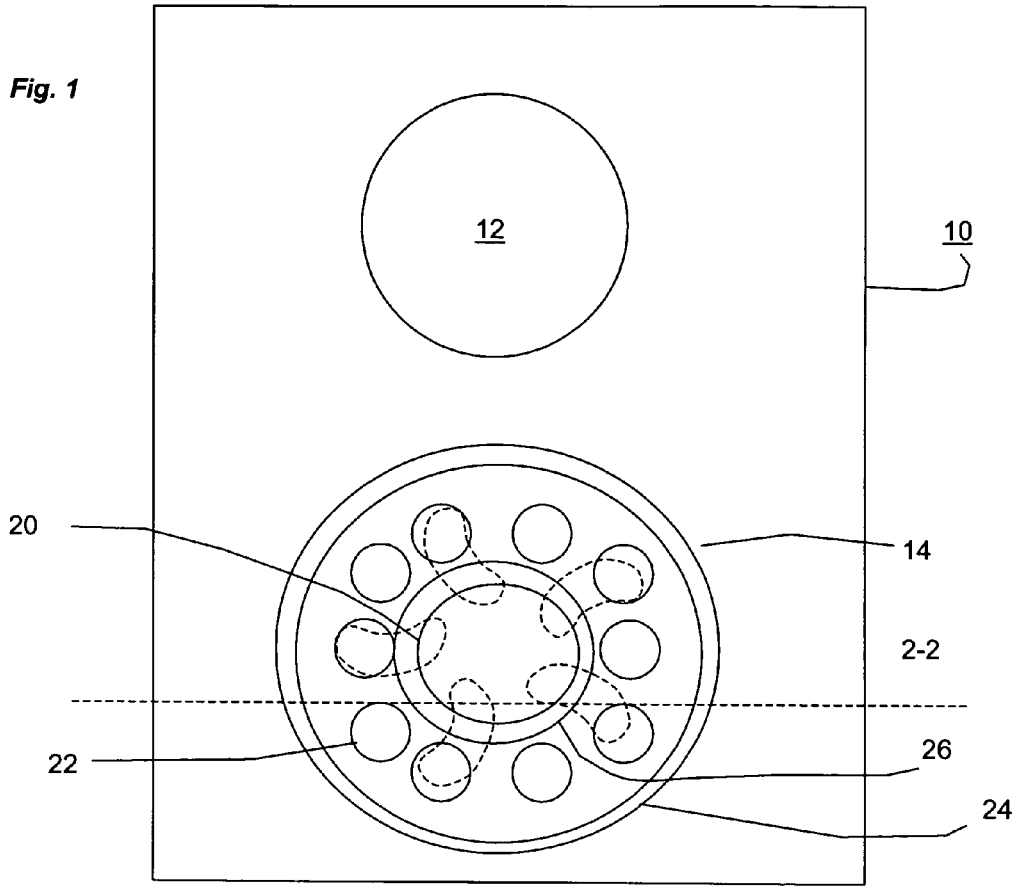
FIG. 1 is a top plan view of one form of CMP tool with which the present invention may be used.
Figure 2:
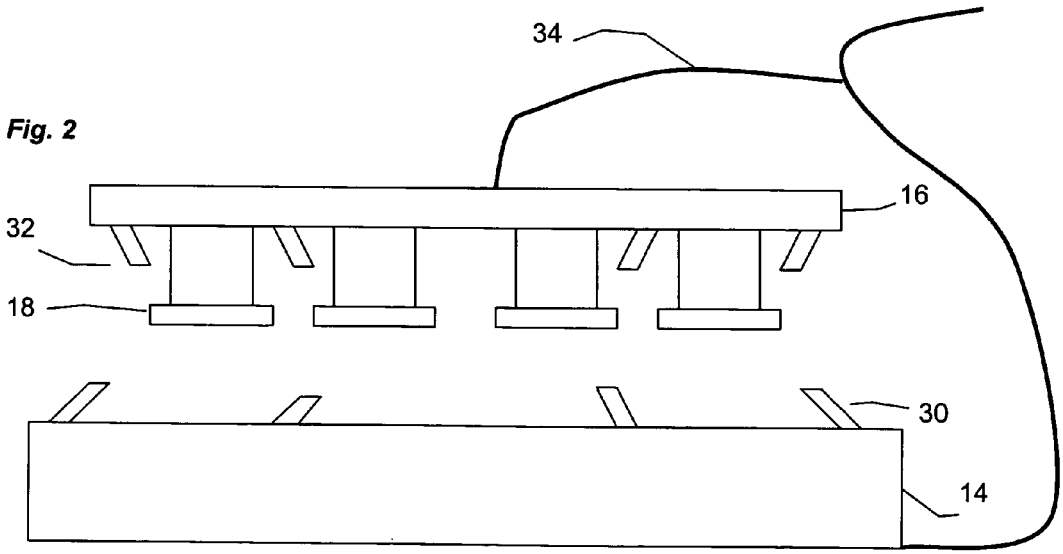
FIG. 2 is an elevation view taken along the lines 2—2 of FIG. 1.

Referring now to FIGS. 1 and 2, FIG. 1 being highly simplified top plan view and FIG. 2 being an elevation view from the line 2—2, there is shown one form of a CMP machine 10 including a polishing pad 12 and an indexing table 14. Above the indexing table is positioned a movable turret 16 to which is attached a plurality of wafer carriers 18. The turret 16 is essentially a plate-like structure having a plurality of wafer carriers 18 mounted thereon. Not shown in either of these views is the mounting mechanism for the wafer carriers which generally comprises a plurality of arms that pass through the turret 16 and are attached to each of the carrier heads through a gimbal (not shown). The attachment through the gimbal allows each of the carriers to be spun at a relatively high speed to achieve the uniform polishing when the turret is moved into the polishing position over the polishing pad 12. For a more detailed description of the exemplary machine 10, reference may be had to U.S. Pat. No. 6,520,839.

The turret 16 is provided with a plurality of circumferentially spaced slots 20 that provide a path for the carriers 18 to be moved from a radially outward position around the turret to a radially inner position. The inner position is used solely for the purpose of transporting the turret from a loading and an unloading position over the indexing table to a polishing position over the polishing pad 12. The carriers are normally positioned in the outer extreme of each of the slots 20 during the polishing operation at the pad 12 and during the unloading and loading functions over the index table 14. During the CMP polishing process, a slurry flows over the polishing pad 12 and is used to achieve polishing of the semiconductor wafers. This slurry accumulates on both the wafers and the carriers 18. When the turret 16 is transported back to the indexing table for unloading of the polished wafers, the wafers are unloaded into corresponding ones of a plurality of plastic cups that are located on the indexing table and are indicated in FIG. 1 at 22. The cups 22 define wafer loading and unloading stations. Commonly, the indexing table has an outer wall 24 and an inner wall 26 which defines a trough in which the plastic cups reside. This trough is generally filled with a cleaning fluid, typically water, which is constantly circulated and cleaned and is used to clean the slurry from the wafers. However, the carriers 18 do not protrude into the water on the indexing table and are therefore not cleaned when the wafers are unloaded. As a consequence, it is necessary to clean the carriers 18 between the steps of unloading polished wafers and loading new wafers to be polished. As shown in FIG. 2, there are multiple spaced spray nozzles 30 located on the indexing table that are angled upward and positioned between the respecting loading and unloading stations for cleaning the underside of the carriers 18. More particularly, once the carriers 18 have unloaded the wafers, the turret 16 is rotated so that the carriers are positioned between loading and unloading cups 22 and a corresponding one of the spray nozzles sprays a stream of water upward onto the lower face of a respective one of the carriers to wash any slurry away from the carriers so that the slurry will not interfere with the loading of a subsequent wafer into the carrier.

In order to improve this cleaning process, applicant's have attached another plurality of spray nozzles 32 onto the turret 16 and positioned the nozzles to aim downward toward the backs of the carriers 18 so that a spray of water can be directed onto the back of the carriers at the same time that the front face of the carriers is washed by the spray from the nozzles 30. This process removes any slurry or dried slurry compound from the backside of the wafer carriers so that such compound is not carried back to the polishing pad 12 when a next group of wafers are loaded and transported for polishing. It will be appreciated that the water for washing the back side of the wafer carriers 18 may come from the same source as the water used for washing the front face of the carrier by simply splitting off from the water source and coupling through a flexible tube to a distribution system mounted to the top of the turret 16. Such a system is indicated generally at 34.

The present invention provides a method and apparatus associated with the CMP machine 10 for assuring that the slurry which is routinely deposited on the back side of the carriers 18 is removed from those carriers at the indexing station so that when the carriers are next positioned over the polishing pad 12, dried material from the back of the carriers will not be deposited on the polishing pad. It will be appreciated that any such dried material could scratch the semiconductor wafers during the polishing process.

Those skilled in the art will appreciate in view of the teachings herein that different types of CMP machines (or tools) may be configured to implement a spray function designed for washing the back side of a carrier in conjunction with the polishing process. CMP machines may be equipped with one or more spray nozzles and configured such that fluid is ejected out of the nozzle and aimed at the back side of a carrier so as to wash off undesired slurry components. The spray nozzle may be mounted to the CMP machine and connected to a fluid source. The functioning of the CMP process is typically coordinated by software. CMP machine software may be configured to include the function of actuating the spraying of fluid out the spray nozzle at an appropriate time during a normal routine of a CMP machine. Furthermore, existing machines may be retrofitted with a spray nozzle and their software reconfigured to implement the spraying of the back of a carrier.

While the invention has been described in what is presently considered to be preferred embodiment, other modifications and variations will become apparent to those skilled in the art. It is intended therefore that the invention not be limited to the specific disclosed embodiment but be interpreted within the full spirit and scope of the appended claims.

What is claimed is:

1. A process for in situ cleaning of a back side of a carrier used in a CMP tool for holding a semiconductor integrated circuit wafer onto a polishing pad during a polishing process of the wafer without interrupting a normal process flow in the CMP tool, wherein the polishing process employs a slurry containing abrasives which can be deposited on both a front and back surface of the wafer carrier, the cleaning process comprising introducing a spray to wash the back surface of said carrier at a predetermined time in the process flow so as to remove slurry from the back side of the carrier whereby contamination of the polishing pad with agglomerated slurry abrasives is avoided, wherein said spray washing of the carrier back surface comprises spraying through a back side spray nozzle mounted within said CMP tool and wherein the carrier is held by a spindle that is mounted to a turret and wherein the back side spray nozzle is mounted to the turret.

2. The cleaning process of claim 1 wherein the CMP tool includes a plurality of spray nozzles for directing a fluid over the front surface of the carriers at a time when the carriers are not loaded with a wafer, the process including spray washing the back surface of the carriers concurrently with spray washing of the front surface.

3. The process of claim 2, wherein said fluid is deionized water.

4. The process of claim 1, wherein said slurry components comprise silica.

5. A CMP tool having a polishing area containing a spinning polishing pad and a slurry dispensing system for introducing a slurry containing an abrasive onto the polishing pad, the tool further having a semiconductor wafer loading and unloading area including an indexing table containing defined areas for holding wafers to be polished and for receiving wafers that have been polished, the tool including a transport apparatus moveable between the polishing area and the indexing table, the transport apparatus including a turret having a plurality of wafer carriers coupled thereto and driving mechanism for effecting spinning of the carriers when the carriers are positioned over the polishing pad, the tool further having a plurality of spray nozzles fixed to the indexing table for directing a spray of fluid onto the lower front surface of the carriers as the carriers are transitioned from an unloading area to a loading area over the indexing table, and a plurality of fluid spray nozzles mounted on the turret and positioned to direct a spray of fluid onto the upper back surface of the carriers concurrently with spraying of fluid onto the front surface of the carriers whereby slurry accumulating on the front and back surfaces of the carrier are washed away over the indexing table.

* * * * *